US006609402B2

(12) United States Patent
Blankenship et al.

(10) Patent No.: US 6,609,402 B2
(45) Date of Patent: Aug. 26, 2003

(54) ELECTRONIC KEY ASSEMBLY WITH SPRING LOADED DATA PIN AND CONTACT

(75) Inventors: Brian David Blankenship, Colorado Springs, CO (US); Alan Doerr, Tomball, TX (US); Pete Kajuch, Brookfield, WI (US)

(73) Assignee: Schlage Lock Company, Colorado Springs, CO (US)

( * ) Notice: Subject to any disclaimer, the term of this patent is extended or adjusted under 35 U.S.C. 154(b) by 160 days.

(21) Appl. No.: 09/765,811

(22) Filed: Jan. 19, 2001

(65) Prior Publication Data

US 2001/0028299 A1 Oct. 11, 2001

Related U.S. Application Data

(60) Provisional application No. 60/195,492, filed on Apr. 6, 2000, and provisional application No. 60/222,832, filed on Aug. 4, 2000.

(51) Int. Cl.[7] ..... E05B 19/04

(52) U.S. Cl. ..... 70/408; 70/460; 70/283.1; 70/278.2

(58) Field of Search ..... 70/460, 408, 277, 70/278.1, 278.2, 278.3, 278.7, 283.1, 280–282

(56) References Cited

U.S. PATENT DOCUMENTS

| | | | | | |
|---|---|---|---|---|---|
| 4,312,198 | A | | 1/1982 | Sedley | 70/276 |
| 4,366,688 | A | | 1/1983 | Bennett | 70/395 |
| 4,440,011 | A | | 4/1984 | Klein | 70/438 |
| 4,562,712 | A | | 1/1986 | Wolter | 70/456 R |
| 4,663,952 | A | | 5/1987 | Gelhard | 70/278 |
| 4,868,409 | A | | 9/1989 | Tanaka et al. | 307/10.5 |
| 4,947,662 | A | * | 8/1990 | Imedio | 70/395 |
| 5,003,801 | A | | 4/1991 | Stinar et al. | 70/278 |
| 5,010,750 | A | | 4/1991 | Boser et al. | 70/276 |
| 5,091,771 | A | | 2/1992 | Bolan et al. | 357/74 |
| 5,156,032 | A | | 10/1992 | Edgar | 70/278 |
| 5,255,547 | A | | 10/1993 | Burr et al. | 70/252 |
| 5,281,945 | A | | 1/1994 | Keppner et al. | 345/146.2 |
| 5,311,757 | A | | 5/1994 | Spahn | 70/408 |
| 5,367,295 | A | | 11/1994 | Gokcebay et al. | 340/825.31 |
| 5,433,096 | A | | 7/1995 | Janssen et al. | 70/278 |
| 5,435,160 | A | | 7/1995 | Linsalato et al. | 70/408 |
| 5,437,174 | A | | 8/1995 | Aydin | 70/278 |
| 5,507,162 | A | * | 4/1996 | Chhatwal | 70/278.3 |
| 5,541,581 | A | | 7/1996 | Trent | 340/825.31 |
| 5,542,274 | A | | 8/1996 | Thordmark et al. | 70/495 |
| 5,548,984 | A | * | 8/1996 | Miyatsu | 70/276 |
| 5,552,777 | A | | 9/1996 | Gokcebay et al. | 340/825.31 |
| 5,689,985 | A | | 11/1997 | Chamberlain | 70/438 |
| 5,771,722 | A | * | 6/1998 | DiVito et al. | 70/277 |
| 6,209,367 | B1 | * | 4/2001 | Hyatt et al. | 70/278.2 |
| 6,442,986 | B1 | * | 9/2002 | Russell et al. | 70/278.3 |

FOREIGN PATENT DOCUMENTS

| | | |
|---|---|---|
| DE | 41 41 270 A 1 | 6/1993 |
| GB | 2 039 321 A | 8/1980 |
| GB | 2 263 302 A | 7/1993 |

* cited by examiner

*Primary Examiner*—Anthony Knight
*Assistant Examiner*—John B. Walsh
(74) *Attorney, Agent, or Firm*—Michael Best & Friedrich LLP

(57) ABSTRACT

This invention relates generally to an electronic touch key for electronic lock sets, and more particularly to an electronic key for use with a lock set. In an electronic key according to the invention, a cylinder plug associated with the lock set includes a fixed data contact pin, which is preferably flush with the face of a cylinder plug, to prevent tampering. The electronic key thus is designed to properly contact the fixed data contact associated with the lock set for proper operation. The present invention provides a construction which facilitates making the contact, and yet provides a durable and simple construction for the electronic key.

17 Claims, 8 Drawing Sheets

ELECTRONIC KEY ASSEMBLY WITH SPRING LOADED DATA PIN AND CONTACT

This application claims the benefit of U.S. Provisional Application No. 60/195,492 filed Apr. 6, 2000, and U.S. Provisional Application No. 60/222,832 filed Aug. 4, 2000, both incorporated by reference herein.

TECHNICAL FIELD

This invention relates to an electronic key assembly for use with an electronic lock assembly, having a spring loaded data pin and contact for providing a touch pressure signal and data transfer for operation of the electronic lock assembly.

BACKGROUND OF THE INVENTION

In many environments, such as apartment houses, multi-family dwellings, condominiums or the like, the transient nature of residents present problems in using conventional locking mechanisms in association with a door having a latch which is operable from both sides of the door by means of a handle or the like. In such environments, keys usable to unlock conventional lockable latching mechanisms are easily replicated, thereby potentially compromising the security provided by the lockable latching mechanism. As tenants or occupants move from such an environment, a key or copy of the key can be retained, though the former tenant or occupant is no longer entitled to access thereto. Similarly, if maintenance or repair procedures require access by other personnel, maintaining security may again be compromised if keys are duplicated or not returned by the repair or maintenance personnel. Thus, security standards in such environments may require that the lock be removed in its entirety and replaced, or the lockable latching mechanism is swapped with another mechanism from another unit to ensure security. Another alternative is to have the lockable latching mechanism re-keyed such that the previous key will not operate the mechanism. In each of these situations, the replacement, re-keying or swapping of the lockable latching mechanism is costly, both in terms of expense and/or personnel resources, and presents a time consuming and inefficient process for ensuring security.

Attempts have therefore been made to provide enhanced security by providing an electronic lock which employs a programmable processor which can be programmed to only allow operation of the lock if a valid key is used. Thus, when a tenant moves from a premises, the electronic lock can simply be reprogrammed so that the old key will not operate the lock, thereby eliminating the need to replace or re-key the lock. Although electronic locks using card readers, key pads or contact activated data ports are known, various deficiencies in such electronic lock assemblies have been found, and such systems have generally been cost prohibitive or complex, thereby limiting widespread use in such environments.

SUMMARY OF THE INVENTION

Based upon the foregoing deficiencies, this invention relates generally to an electronic touch key for electronic lock sets, and more particularly to an electronic key for use with a lock set, which provides a signal to the user that an authorized key has been properly applied to the lock.

The electronic key is a touch key, which operates the locking mechanism by merely touching the key to an electronic sensor on the lock set. Typically an electronic lock set provides either an audible and/or visible signal that the touch key has been properly applied, and that the door has been unlocked.

As an example, an electronic access control deadbolt may be operated by an electronic key according to the invention, wherein a cylinder plug associated with the lock set includes a fixed data contact pin, which is preferably flush with the face of a cylinder plug, to prevent tampering. The electronic key thus must be designed to properly contact the fixed data contact associated with the lock set for proper operation, presenting problems in forming the proper contact upon insertion of an electronic key. To facilitate making this proper contact with the fixed data contact pin associated with the lock set, the present invention provides a construction which facilitates making the contact, and yet provides a durable and simple construction for the electronic key.

The foregoing and other aspects will become apparent from the following detailed description of the invention when considered in conjunction with the accompanying drawings.

DETAILED DESCRIPTION

Figure 1:
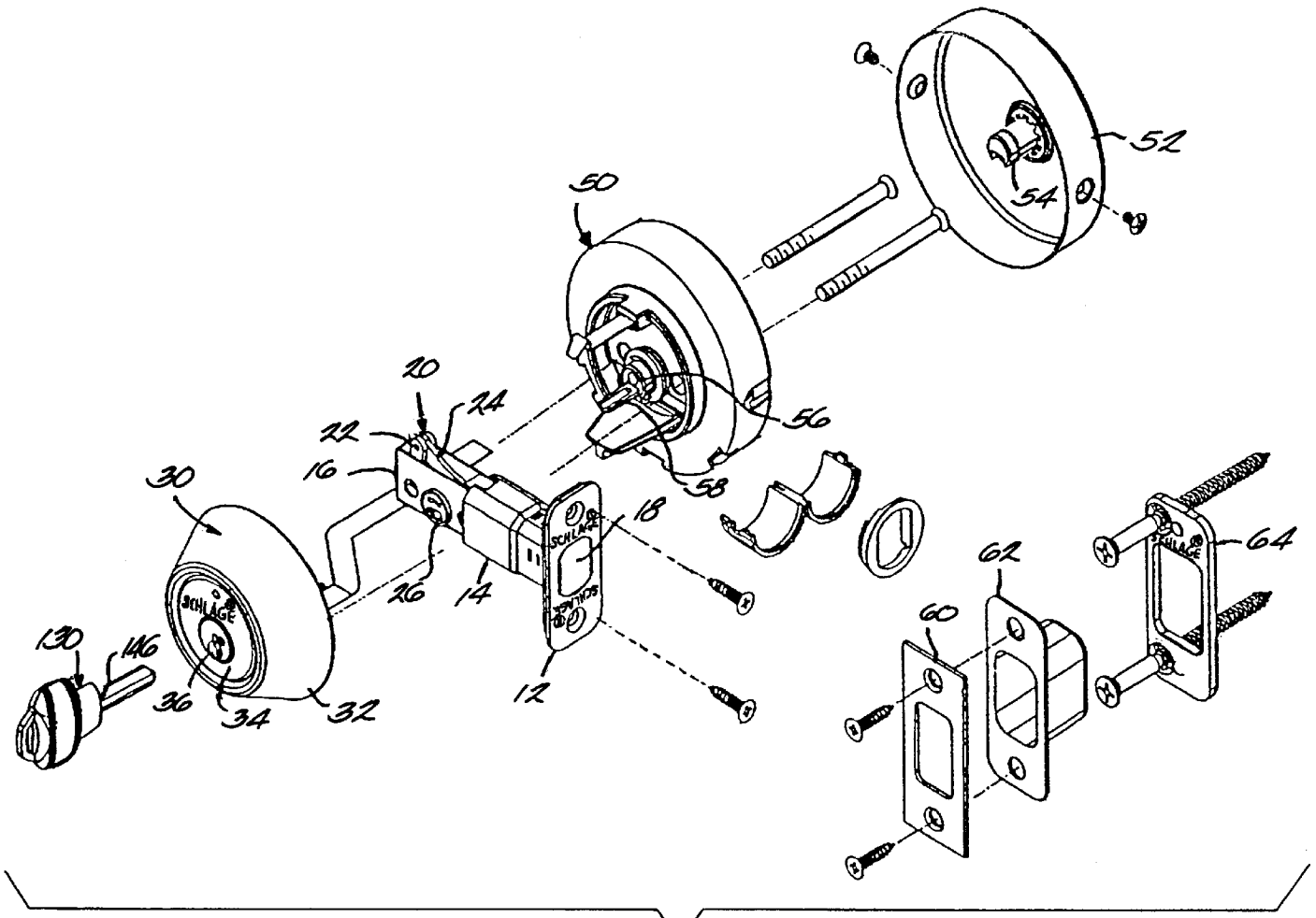
FIG. 1 is a perspective exploded schematic view showing an electronic deadbolt locking mechanism according to an embodiment of the invention.

Turning now to FIG. 1, the present invention will be described in conjunction with an embodiment relating to an electronic deadbolt assembly. As shown in FIG. 1, the deadbolt assembly 10 may include a faceplate 12, which will normally be visible from the edge of the door. A front case 14 may be joined to the front plate 12, and a rear case 16 is provided in telescopic adjustable relationship to the front case 14. A deadbolt 18 is provided in slideable relationship within the front cast 14, and is coupled to a swivel generally indicated at 20. The swivel mechanism may include a pair of ears 22 connected to a link 24. The link 24 is connected to the bolt 18 in a suitable fashion, and operation of the deadbolt 18 between a fully extended position and a retracted position is provided by means of a spindle 26 in a known fashion. In general, spindle 26 is engaged between inner and outer cylinders, wherein upon rotation of the cylinders, spindle 26 rotates to cause corresponding movement of the swivel 22 and link 24 and movement of deadbolt 18 between extended and retracted positions. The structures of the front case 14, rear case 16 and operation of the deadbolt 18 is typical, and details of this construction and operation may be modified in accordance with known mechanisms.

The deadbolt assembly 10 as shown in FIG. 1 further comprising an outside housing assembly 30, which includes an outside rose 32 and a lock cylinder or cylinder plug 34. The cylinder plug 34 includes a keyway 36, into which an electronic key 130 is inserted for operation of the deadbolt. The deadbolt assembly 10 may further comprise an inside turn assembly generally designated 50, over which an inside rose 52 is positioned. A thumbturn 54 engages the inside turn assembly 50 in a known manner, such that operation of the thumbturn 54 coupled to the inside turn assembly 50, and more particularly to thumbturn extension 56 having an outwardly extending portion 58 which engages spindle 26 in the deadbolt assembly 10. Thus, upon rotation of the thumbturn 54 on the interior of the door, rotation of the thumbturn 54 will in turn cause rotation of thumbturn extension 56 and extending portion 58 so as to operate spindle 26 causing corresponding extension or retraction of the deadbolt 18 in a known fashion. The deadbolt 18 in its extended position engages a strike 60 positioned on the door jam, and an associated strike box 62. A strike reinforcer 64 may be provided to enhance the structural integrity and security of the deadbolt latch.

It should be recognized that operation of a thumbturn 54 in conjunction with the inside turn assembly 50 to selectively extend or retract the deadbolt 18 is generally known, and will not be described further.

Figure 2:
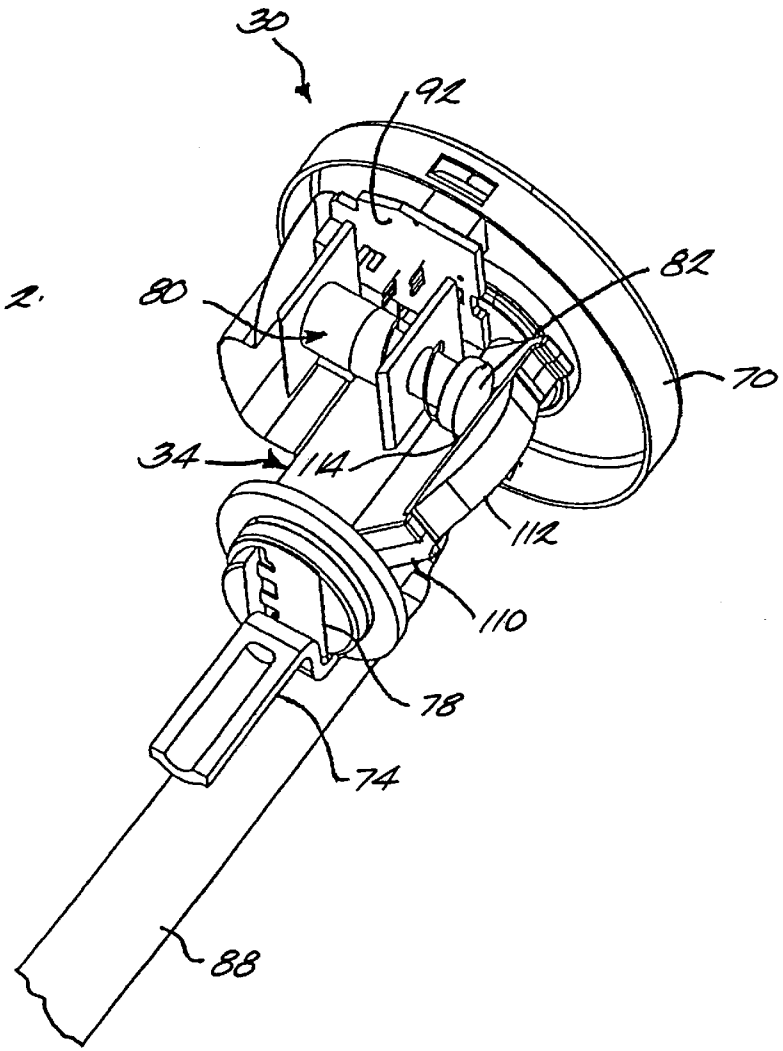
FIG. 2 is a perspective schematic view of a cylinder housing assembly.
Figure 3:
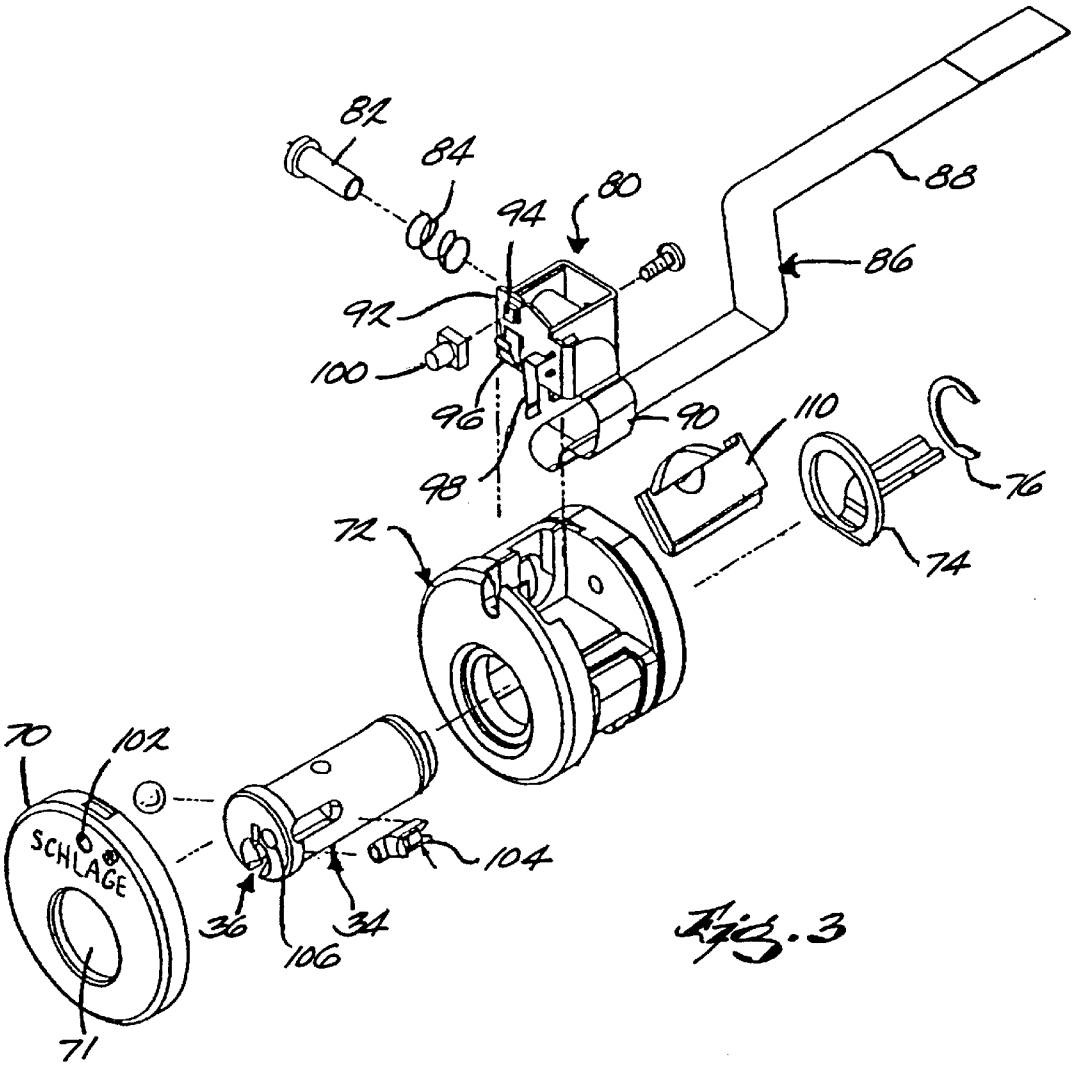
FIG. 3 is an exploded perspective view of the cylinder housing assembly as shown in FIG. 2.

Turning now to FIGS. 2 and 3, the outer housing assembly is shown in more detail. The outside housing assembly 30 includes a cylinder housing cap 70 having a hole 71 through which the cylinder plug 34 is exposed at the outside of the lock assembly. In this manner, keyway 36 will be exposed on the exterior of the lock assembly for access by an electronic key. The cylinder plug 34 is dimensioned to extend within a cylinder outside housing 72, and is selectively rotatable within cylinder outside housing 72 by means of an authorized electronic key positioned within keyway 36. The cylinder outside housing 72 is removed from FIG. 2 for clarity of other elements situated within housing 72. After insertion of the cylinder plug 34 into housing 72, the rearward or opposing end of cylinder plug 34 disposed opposite keyway 36 engages a cylinder tailpiece 74 which is retained thereon by a retaining ring 76. The cylinder tailpiece 74 engages the spindle 26 associated with the deadbolt latch assembly as described in FIG. 1. In this matter, rotation of the cylinder plug 34 will in turn cause rotation of the spindle 26 and extends and retracts the deadbolt 18 as previously described. There also may be provided in association with the rearward end of the cylinder plug 34 a pick cap 78 which helps to prevent picking or tampering with the lock assembly.

Figure 6:
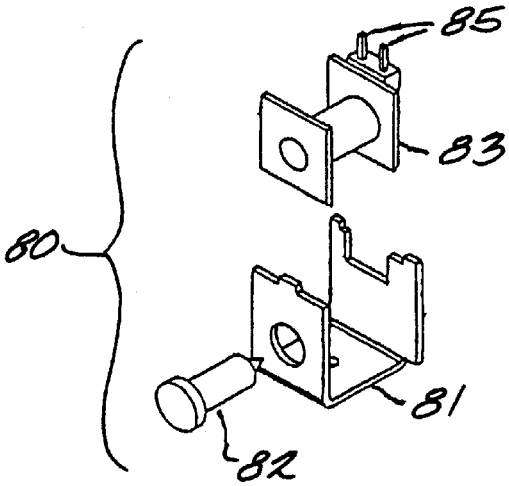
FIG. 6 is an exploded view of the solenoid and plunger according to this embodiment.

Within the outside cylinder housing 72 is positioned a solenoid assembly generally indicated at 80, including a solenoid plunger 82 which is spring biased to an outward position by means of solenoid spring 84. As seen in FIG. 6, the solenoid assembly 80 may comprise a supporting frame 81 in association with a solenoid bobbin 83 to which electrical connection is made via pins 85. The bobbin 83 is inserted and retained therein through an opening in the frame 81. Other suitable configurations to provide solenoid assembly within the lock architecture would be recognized by those of ordinary skill, and are contemplated by the invention. Associated with the solenoid 80 is a flex assembly 86 which includes a flexible electrical connecting interface 88, which carries electrical signals to a microprocessor housed within the inside turn assembly 50 as described with reference to FIG. 1. The flex assembly 86 also couples power to the solenoid 80 from a battery power source housed within inside turn assembly 50 via a clip (not shown) positioned at the end of flexible electrical connecting interface 88. A stiffener 92 is provided to support various components in conjunction with the flex assembly 86, including an LED 94, a ground clip 96 and a data transfer spring 98. A light pipe 100 is associated with the LED 94 to transmit light from LED 94 to the exterior of the electronic lock through an aperture 102 formed in the cylinder housing cap 70. The LED will provide information to the user, as to whether an authorized key is being used (green indicating light), or whether an unauthorized key has been inserted into the electronic lock assembly (red indicating light) as an example. The LED 94 can be multi-colored to allow various light signaling indications to the user. The ground clip 96 electrically grounds the assembly to the outside cylinder housing 72 when the flex assembly 86 and solenoid assembly 80 are inserted into the outside cylinder housing 72. The data transfer spring 98 extends to be electrically coupled in association with a cylinder pin assembly 104 which is housed in association with the cylinder plug 34. The cylinder pin assembly 104 extends to a position to be accessible at the front face of the cylinder plug 34 when positioned therein, through an access hole 106. Preferably, the cylinder pin assembly 104 extends to be flush with the front face of cylinder plug 34. In operation, when an electronic key is inserted into keyway 36, a contact pin 41 associated with the electronic key contacts the cylinder pin assembly 104 which is in electrical wiper contact with the data transfer spring 98 to communicate data from the electronic key through the flex assembly 86 to the microprocessor. If an authorized key is used, the microprocessor will in turn send a signal through the flex assembly 86 to the solenoid assembly 80 to selectively withdraw the solenoid plunger 82 against the force of bias spring 84.

Figure 4:
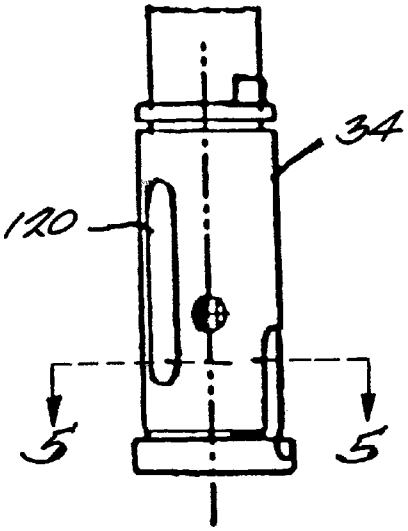
FIG. 4 is a side elevational view of the cylinder plug according to this embodiment.
Figure 5:
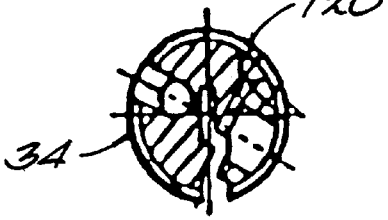
FIG. 5 is a cross sectional view taken along line 5—5 in FIG. 4.
Figure 8:
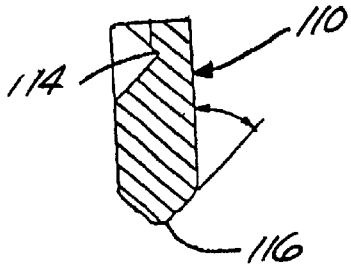
FIG. 8 is a cross sectional view taken along line 8—8 in FIG. 7.

As only an authorized electronic key will provide data to initiate actuation of the solenoid assembly 80 by the microprocessor, rotation of the cylinder plug 34 is otherwise prevented by a rotation preventing member or sidebar 110. The sidebar 110 includes a sidebar spring 112 which biases the sidebar 110 into engagement with the cylinder plug 34, to prevent rotation of the cylinder plug 34 until actuation of the solenoid and withdrawal of the plunger 82. Sidebar spring 112 may comprise one or more of many types of springs and is not limited to the leaf spring type shown. Although not shown, a pair of coil springs could also be used as the sidebar spring 112. As seen in FIGS. 4 and 5, the cylinder plug 34 includes an elongated slot 120 into which a bottom portion of the sidebar 110 is positioned. As seen in FIG. 8, the bottom portion of the sidebar 110 comprises a contoured point 116, which is substantially matched to engage the slot 120 formed in the plug cylinder 34. As shown in FIG. 8, the contoured point 116 may be provided with angled portions, which in this embodiment are approximately 45°, to substantially match the configuration of the slot 120, which in this embodiment is formed as an approximate 90° angled slot as seen in FIG. 5. Upon attempting rotation of the cylinder plug 34, and due to the configuration of the slot 120 in association with the bottom portion 116 of the sidebar 110, the sidebar 110 will be urged outwardly from the slot 120 against bias spring 112. To prevent such movement of the sidebar 110 unless an authorized key is inserted into the cylinder plug 34, the plunger 82 of the solenoid engages the slot 114 formed in the side portion of the sidebar 110. As seen in FIG. 8, the slot 114 may also be configured to have angled sides at approximately 45°, into which the plunger 82 is positioned in its normally extended position. When the plunger 82 is positioned within the slot 114, the sidebar 110 is not able to move outwardly relative to the slot 120 formed in the cylinder plug 34. Thus, rotation of the cylinder plug 34 is prevented, thereby effectively locking the deadbolt mechanism, and not allowing retraction of the deadbolt 18 accordingly. When an authorized electronic key is inserted into the cylinder plug 34, and a data signal is generated by a microprocessor to actuate the solenoid 80, the plunger 82 is withdrawn from the slot 114 for a predetermined period of time. As a user rotates the authorized electronic key, the sidebar 110 will be urged out of the slot 120 in the cylinder plug 34 against the force of the bias spring 112, to thereby selectively allow rotation of the cylinder plug and actuation of the deadbolt mechanism to retract the deadbolt 18 and allow opening of the door. After actuation of the deadbolt mechanism by an authorized electronic key, the cylinder plug 34 is rotated back to its initial position, and the sidebar spring 112 urges sidebar 110 back into slot 120 in the cylinder plug 134 and the solenoid plunger 82 into slot 114, to thereby lock rotation of the cylinder plug at the home position until further actuation.

In this embodiment of the invention, upon insertion of an authorized electronic key into the cylinder plug 34, the microprocessor will withdraw the solenoid plunger from the slot 114 for a predetermined amount of time. It may be desirable to provide a short delay occurring between actuation of the solenoid and return of the plunger to its normally extended position. The microprocessor may therefore be programmed to cause retraction of the plunger to accommodate a slight delay which may occur between insertion of an authorized electronic key and the user rotating the cylinder plug 34 for actuation of the deadbolt mechanism. If the user does not rotate the cylinder plug 34 after insertion of an authorized electronic key, the system will time out and the plunger will return to its normally extended position to engage slot 114 and lock the mechanism accordingly.

Figure 9:
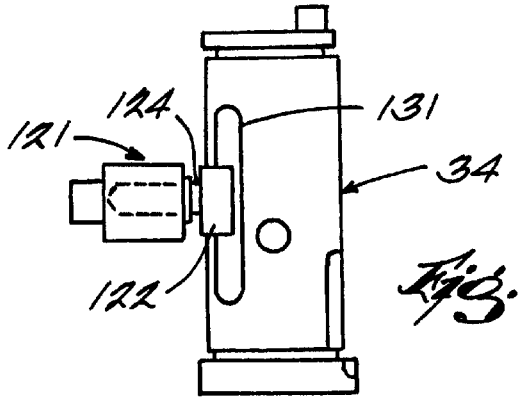
FIG. 9 is a top elevational view of an alternate embodiment of a solenoid/cylinder locking mechanism.
Figure 7:
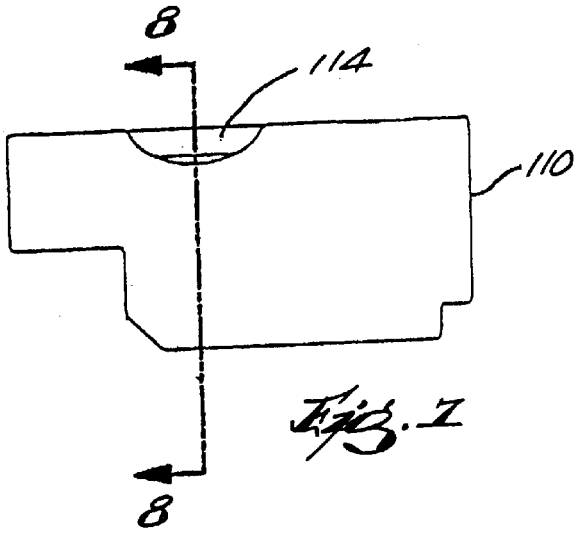
FIG. 7 is a side elevational view of a sidebar according to this embodiment.

In an alternative embodiment as shown in FIG. 9, the sidebar 110 is eliminated, and a solenoid 121 including a solenoid plunger 122 and bias spring 124 act directly in conjunction with the plug cylinder 34 to selectively lock rotation thereof. In this embodiment, the plunger 122 in its normally extended position will engage a slot 131 formed on the cylinder plug 34, whereby rotation of the cylinder plug 34 is prevented until actuation of the solenoid 121 and retraction of the plunger 122 by microprocessor control. Upon actuation of the solenoid 121, and retraction of the solenoid plunger 122, the cylinder plug 34 is able to rotate to thereby operate the deadbolt mechanism in the desired manner, and upon return of the cylinder plug to its home position, the plunger 122 will again engage the slot formed in the cylinder plug 34 to lock rotation thereof. Other operational features in this embodiment may be similar to that described with reference to the previous embodiment.

The lock mechanism according to the present invention provides an electronically actuable mechanism which is simple in construction and yet effective to provide enhanced security in a variety of environments. The mechanism can be used to replace conventional locking mechanisms, such that no other preparation of a door or the like is necessary, and allows the user to simply reprogram the mechanism to allow only authorized electronic keys to be used therewith in the desired manner. No re-keying or replacement of the locking mechanism is required to maintain security of the mechanism, thereby avoiding cost or labor associated with such procedures. The lock mechanism has a limited number of parts, and is extremely reliable, and is cost-effective in its implementation.

Figure 10:
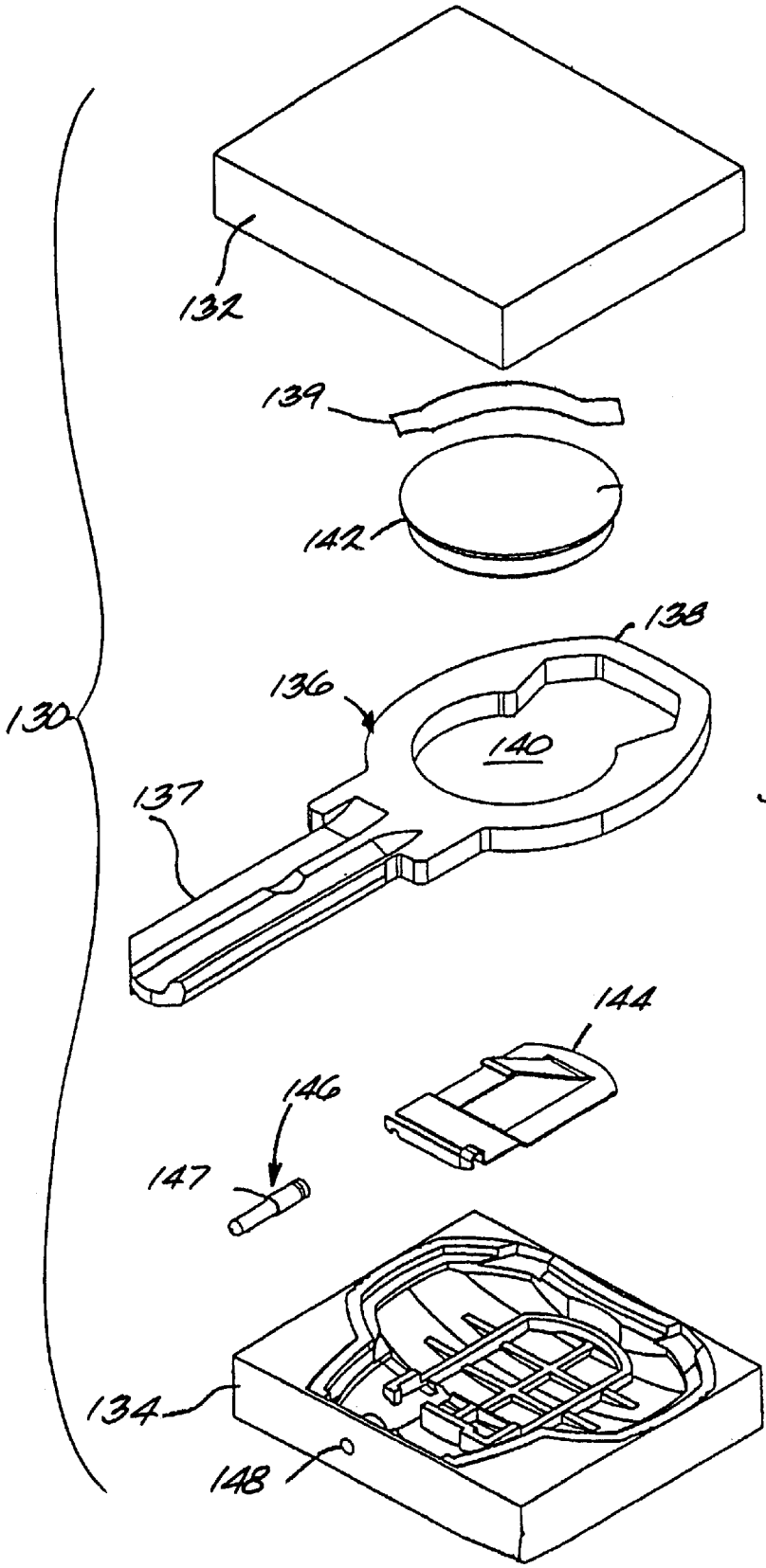
FIG. 10 is an exploded perspective view of an electronic key assembly according to an embodiment of the invention.

Turning now to FIG. 10, the electronic key according to the invention is shown in more detail. The electronic key 130 as shown in FIG. 10, comprises an upper case 132 and a lower case or housing 134 which house components of the electronic key therein. A key 136 includes a head portion 138 having a central opening 140 which accommodates a memory cell or control key 142, such as an ibutton® in snap fitting relationship. An outwardly extending portion 137, similar to a typical key, is insertable into the electronic lock for operation. The portion 137 may be provided with suitable cuts to operate a typical lock mechanism if desired. For example, an electronic lock may be operated by the key 130, such as for use with a residence, while key cuts formed in portion 137 provided to operate another standard lock, such as associated with a pool gate, exercise room or other amenities usable by the resident. Any suitable type of memory cell 142 and associated assembly with a key 136 may be provided as desired. As seen in FIG. 10, a data contact 144 and data pin 146 are provided to allow electrical connection to the memory cell 142 when mounted within the upper and lower housing members 132 and 134. To ensure proper positioning of the memory cell 142 with respect to the data contact 144, the upper housing 132 may be provided with a portion which engages the memory cell 142 to bias it into the proper position when assembled with the lower hosing 134. Alternatively, a spring member 139 may be positioned with housing member 132 to bias memory cell 142 into engagement with data contact 144, such as a wave spring 239 (shown in an alternate configuration in FIG. 10A, fully discussed below), or the like.

Figure 10A:
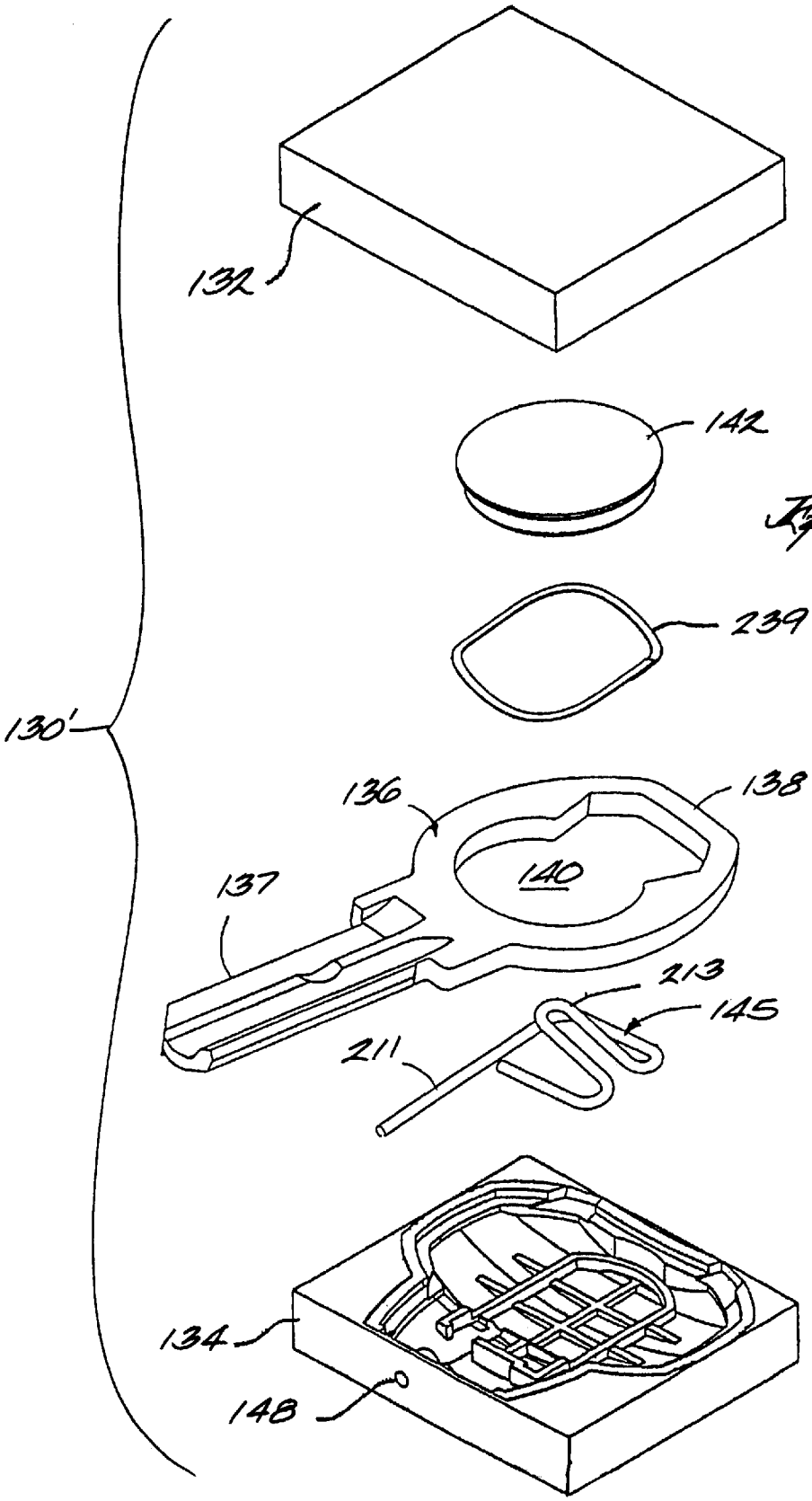
FIG. 10A is an exploded perspective view of an electronic key assembly according to an alternate embodiment of the invention.

An alternate embodiment of key 130 is shown as key 130' in FIG. 10A in which data contact 144 and data pin 146 are replaced by a one piece spring contact data pin 145. The one-piece spring contact data pin 145 comprises an extension portion 211 and a memory cell contact portion 213. The memory cell contact portion 213 is configured at an angle in relation to extension portion 211 such that the spring contact data pin 145 is biased toward a memory cell 142 to ensure proper contact is established with the spring contact data pin 145. Extension portion 211 extends a predetermined distance outside of housing 134 through aperture 148, when assembled, similar to the embodiment shown in FIG. 10 and fully described below. Spring contact data pin 145 is similar to the invention disclosed in U.S. Provisional Application No. 60/222,832 filed Aug. 4, 2000, entitled ONE PIECE KEY CONTACT SPRING, herein incorporated by reference.

Figure 11:
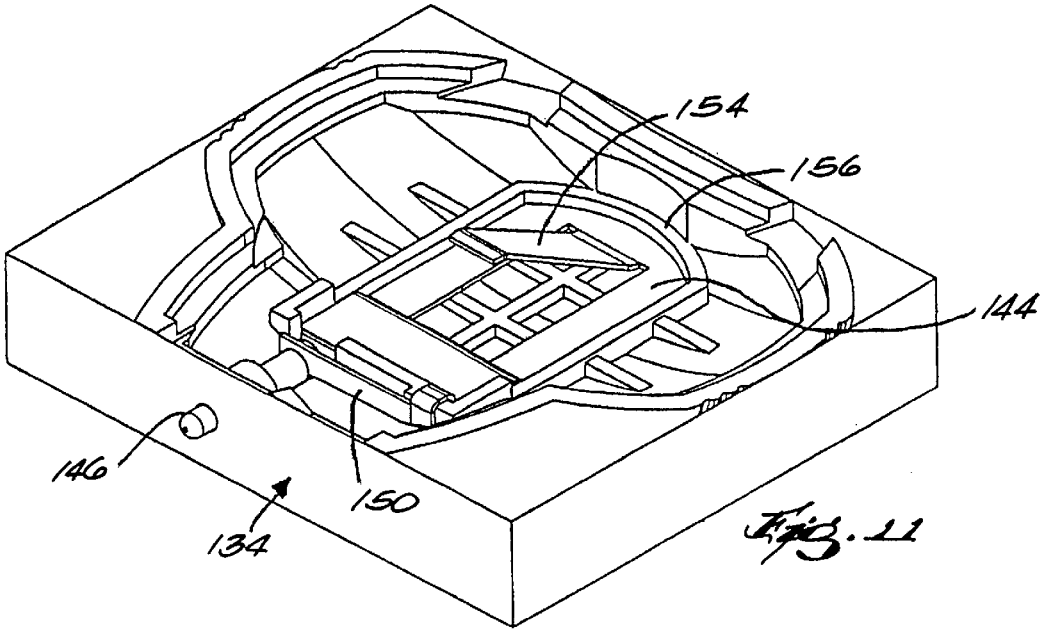
FIG. 11 is a perspective view of a lower housing and assembled data contact and data pin associated with the electronic key.
Figure 12:
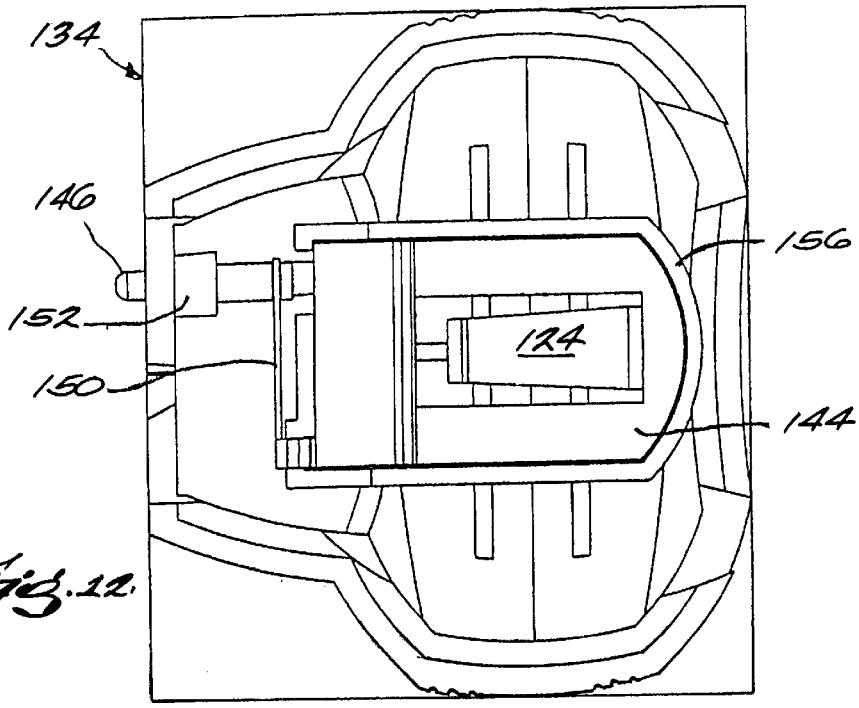
FIG. 12 is a top elevational view of the lower housing as shown in FIG. 10, with the data contact and data pin installed therein.

Turning to FIGS. 11 and 12, the assembly of the data contact 144 and data pin 146 is shown in more detail. The lower housing 134 includes an aperture 148 as seen in FIG. 10, which accommodates the data pin 146, allowing data pin 146 to extend a predetermined distance outside of housing 134. Upon insertion of the electronic key 130 into the cylinder plug 34 of the locking mechanism, the outward extension of data pin 146 from the front of housing 134 allows for touch contact to the fixed data contact pin 104 associated with the cylinder plug. To facilitate this contact, data pin 146 is outwardly biased by means of a spring member 150 associated with the data contact 144. Spring loading of the data pin 146 facilitates proper contact to the fixed data contact pin 104, which is preferably positioned such that its outer extent is flush with the face of the cylinder plug to prevent tampering. In this embodiment, movement of the data pin 146 from the extended position as shown in FIGS. 11 and 12 is accommodated, and accounts for the different possible manners in which a user will insert the electronic key for operation of the locking mechanism. In this embodiment, the spring loaded data pin 146 can move between the fully extended position as shown in FIGS. 11 and 12, and a retracted position in which the data pin 146 is flush with the shoulder of the key housing 134, upon insertion of the key 130 into the cylinder plug 34. At the same time, the spring member 150 will not allow movement of the data pin 146 beyond this flush position with the exterior of the housing 134 at aperture 148, to prevent data pin 146 from being retracted into the housing 134. Upon removal of the electronic key 130 from the cylinder plug 34, the force of spring member 134 will force the data pin 146 to its fully extended position as shown in FIGS. 11 and 12. The outward extent of the data pin 146 is also preferably controlled by a stop portion 147 formed thereon, which has dimensions greater than the aperture 148 to limit the outward movement of data pin 146. It should also be seen that the data pin 146 is electrically isolated in its position within housing 134, except the electrical contact with the data contact 144 and spring member 150 associated therewith.

As previously described, the key blank 136 allows the memory cell 142 to be press fit or otherwise connected into the ribbed circular opening 140 in the key blank 136. Upon assembly of the key blank 136 and associated memory cell 142 in conjunction with upper and lower housing members 132 and 134, the data contact 144 will complete electrical connection between the memory cell 142 and the data pin 146. The data contact 144 has an upwardly extending contact spring 154 which will engage the isolated data terminal of the memory cell 142 formed on the bottom surface thereof. Upon assembly of the key blank 136 and associated memory cell 142 in association with the lower housing member 134, the contact spring 154 will positively engage the data terminal of the memory cell 142. The contact spring 154 will be depressed upon assembly of key blank 136 and memory cell 142 therewith, such that an upward bias pressure will maintain the desired electrical contact between contact spring 154 and the data terminal associated with the memory cell 142.

To facilitate assembly of the electronic key 130, the upper and lower housing members 132 and 134 may be provided with suitable structure to accommodate the key blank 136 and associated memory cell 142 as well as the data contact 144 and data pin 146. As an example, the lower housing 134 may include an internal framework 156 to accommodate the data contact 144 therein. Other suitable framework or housing structures can be formed on the interior of the housings 132 and 134 to facilitate assembly as desired.

Housing and movement of the data pin 146 may also be facilitated by a reinforcing structure 152 formed on the interior of housing 134, to engage pin 146 over a larger extent, thereby facilitating proper movement of pin 146 relative to housing 134.

Whereas the invention has been shown and described with reference to particular embodiments thereof, it should be realized that there may be many modifications, substitutions or alterations thereto which are encompassed within the scope of the invention. The embodiments of the invention in which an exclusive property or privilege is claimed are defined as follows.

What is claimed is:

1. An electronic key comprising:

a housing;

a key blank having a portion for insertion into a keyway of an electronic lock assembly, the key blank being attachable to the housing;

a memory cell positioned within the housing for supplying data relating to the electronic lock assembly intended to be operated by the electronic key; and a data pin positioned to extend through an aperture formed in the housing and being electrically connected to the memory cell for transmitting data supplied thereby, wherein the key blank has an opening to accommodate the memory cell in association therewith.

2. The electronic key according to claim 1, wherein the housing has a front surface from which the-data pin protrudes in its extended position, for touching and operating an electronic lock as the key is moved toward the lock with the front surface facing the electronic lock, and the data pin is movable between its extended position to a position flush with the front surface of the housing upon insertion into the electronic lock.

3. The electronic key according to claim 1, wherein the data pin includes a stop portion to limit the outward extent of its movement relative to the housing.

4. The electronic key according to claim 1, wherein the data pin is biased by a spring member toward an outwardly extended position, and wherein the spring member limits the inward movement of the data pin with respect to the housing.

5. The electronic key according to claim 1, wherein the data pin is biased by a spring member toward an outwardly extended position, and further comprising a data contact member in electrical connection with the memory cell when mounted in conjunction with the housing, with the spring member being formed in association with the data contact member and electrically connecting the data pin to the memory cell.

6. The electronic key according to claim 1, wherein the data pin is biased by a spring member toward an outwardly extended position, and wherein the spring member is engaged to the data pin, and limits the extent of travel of the data pin from its extended position.

7. The electronic key according to claim 1, wherein the key blank includes an outwardly extending portion adapted to operate a standard lock mechanism.

8. The electronic key according to claim 7, further comprising a data contact member positioned within the housing and having a portion thereof contacting the memory cell, the data contact being an electrical connection with the data pin for transmitting data through the data pin.

9. The electronic key according to claim 1, wherein the data pin is biased by a spring member toward an outwardly extended position, and wherein the spring member electrically connects the data pin to the memory cell throughout movement of the data pin from a fully extended position to a fully retracted position.

10. The electronic key according to claim 1, wherein the data pin is biased by a spring member toward an outwardly extended position, and further comprising a data contact to electrically couple data from the memory cell through the spring member and data pin, the data contact having a contact portion which is spring loaded to maintain contact with the memory cell upon assembly in the housing.

11. The electronic key according to claim 1, wherein the housing includes first and second portions which are assembled together to enclose a portion of the key blank and a portion of the data pin therein.

12. The electronic key according to claim 11, wherein the first and second portions of the housing include structures to position the key blank, memory cell and data pin in proper positions when assembled together.

13. The electronic key according to claim 1, wherein the housing includes a reinforcing member having an aperture formed therethrough into which the data pin is slideably positioned, to engage the data pin over a portion of its length and facilitate proper movement of the data pin relative to the housing.

14. An electronic key comprising:

a housing;

a key blank having a portion for insertion into a keyway of an electronic lock assembly, the key blank being attachable to the housing;

a memory cell positioned within the housing for supplying data relating to the electronic lock assembly intended to be operated by the electronic key; and a data pin positioned to extend through an aperture formed in the housing and being electrically connected to the memory cell for transmitting data supplied thereby, wherein the memory cell is biased into electrical connection with a data contact member which in turn is electrically connected to the data pin.

15. The electronic key according to claim 14, wherein a spring member is positioned within the housing to bias the memory cell.

16. An electronic key comprising:

a housing;

a key blank having a portion for insertion into a keyway of an electronic lock assembly, the key blank being attachable to the housing;

a memory cell positioned within the housing for supplying data relating to the electronic lock assembly intended to be operated by the electronic key; and a data pin positioned to extend through an aperture formed in the housing and being electrically connected to the memory cell for transmitting data supplied thereby, wherein the key blank has an opening for mounting the memory cell therein by interference fit.

17. An electronic key comprising:

a housing;

a key blank having a portion for insertion into a keyway of an electronic lock assembly, the key blank being attachable to the housing;

a memory cell positioned within the housing for supplying data relating to the electronic lock assembly intended to be operated by the electronic key;

a data pin positioned to extend through an aperture formed in the housing and being electrically connected to the memory cell for transmitting data supplied thereby; and a spring member positioned in the housing to bias the data pin to an outwardly extended position, wherein the biasing of the data pin to an outwardly extended position maintains contact of the data pin with a data contact pin associated with the electronic lock assembly from its fully extended position to a fully retracted position.

* * * * *